US009003587B2

(12) United States Patent
Lee et al.

(10) Patent No.: US 9,003,587 B2
(45) Date of Patent: Apr. 14, 2015

(54) DRUM TYPE WASHING MACHINE HAVING TOUCH UP FUNCTION AND METHOD FOR TOUCHING UP THEREOF

(75) Inventors: Deug-Hee Lee, Gyeongsangnam-Do (KR); Pyoung-Hwan Kim, Gyeongsangnam-Do (KR); Eun-Jin Park, Gyeongsangnam-Do (KR); Hyung-Yong Kim, Gyeongsangnam-Do (KR); Seong-Hae Jeong, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 1405 days.

(21) Appl. No.: 12/204,158

(22) Filed: Sep. 4, 2008

(65) Prior Publication Data

US 2009/0056037 A1 Mar. 5, 2009

(30) Foreign Application Priority Data

Sep. 5, 2007 (KR) ..... 10-2007-0090111

(51) Int. Cl.
*D06B 19/00* (2006.01)
*D06F 58/20* (2006.01)
*D06F 39/00* (2006.01)

(52) U.S. Cl.
CPC ..... *D06F 58/203* (2013.01); *D06F 39/008* (2013.01)

(58) Field of Classification Search
CPC . D06F 2216/06; D06F 2224/00; D06F 29/00; D06F 35/00
USPC ..... 8/149.3, 158, 159; 68/5 R, 5 C, 12.12
See application file for complete search history.

(56) References Cited

U.S. PATENT DOCUMENTS

| | | | | |
|---|---|---|---|---|
| 3,575,020 | A * | 4/1971 | Hubbard | 68/4 |
| 5,285,545 | A * | 2/1994 | Payne et al. | 8/158 |
| 2001/0011395 | A1 * | 8/2001 | Skripper et al. | 8/159 |
| 2005/0034248 | A1 * | 2/2005 | Oh et al. | 8/149.3 |
| 2006/0117596 | A1 | 6/2006 | Kim et al. | |

FOREIGN PATENT DOCUMENTS

| | | | |
|---|---|---|---|
| EP | 1275767 | A1 * | 1/2003 |
| EP | 1 657 345 | A2 | 5/2006 |
| EP | 1 852 539 | A1 | 11/2007 |
| KR | 10-2007-0023889 | A | 3/2007 |
| WO | WO 2007/024050 | | 3/2007 |

OTHER PUBLICATIONS

Translation of Dober et al., EP 1275767 A1, Jan. 2003.*
German Office Action dated Apr. 23, 2009.
French Preliminary Search Report dated Sep. 12, 2011 for Application 0855902 (and English language translation).

* cited by examiner

*Primary Examiner* — David Cormier
(74) *Attorney, Agent, or Firm* — KED & Associates, LLP

(57) ABSTRACT

Disclosed is a drum type washing machine having a touch up function and a method for touching up thereof. The drum type washing machine having the touch up function is provided with a touch up button for removing wrinkles on laundry left in the drum type washing machine and a method for touching up. Accordingly, it is not required for a user to additionally execute rinsing and dehydrating processes, or ironing so as to remove wrinkles on the laundry, thus it is convenient. And, since it is not required to additionally execute the rinsing and dehydrating processes, it is capable of preventing unwanted consumption of water and electricity.

18 Claims, 2 Drawing Sheets

DRUM TYPE WASHING MACHINE HAVING TOUCH UP FUNCTION AND METHOD FOR TOUCHING UP THEREOF

RELATED APPLICATION

The present disclosure relates to subject matter contained in priority Korean Application No. 10-2007-0090111, filed on Sep. 5, 2007, which is herein expressly incorporated by reference in its entirety.

BACKGROUND OF THE INVENTION

1. Field of the Invention

The present invention relates to a drum type washing machine having a touch up function and a method for touching up thereof.

2. Description of the Related Art

In general, a drum type washing machine serves to wash laundry by using a friction force between a rotating drum and the laundry and the laundry dropping from a top to a bottom in the rotating drum. Accordingly, in the drum type washing machine, the laundry is little damaged and is not entangled.

In the meantime, when laundry is left alone in the drum type washing machine for a long time in a dehydrated state, since a user has gone out for a long time after operating the drum type washing machine, the laundry may be wrinkled. The wrinkled laundry may not be smoothed out even if it is shaken to be dried.

However, the related art drum type washing machine does not have an additional structure or function for removing the wrinkles. Accordingly, in order to remove the wrinkles, the user should additionally execute rinsing and dehydrating processes for the laundry or ironing the laundry. Here, when additionally executing the rinsing and dehydrating processes for the laundry, which causes unwanted consumption of water and electricity.

SUMMARY OF THE INVENTION

Therefore, the present invention is directed to providing a drum type washing machine having a touch up function for removing wrinkles on laundry. And, another object of the present invention is to provide a method for touching up thereof.

To achieve these and other advantages and in accordance with the purpose of the present invention, as embodied and broadly described herein, there is provided a drum type washing machine having a touch up function, the washing machine comprising a touch up button by which a user can allow to tumble laundry and eject steam at the same time after a dehydrating process is finished, so as to prevent the laundry left after the dehydrating process from wrinkling.

In accordance with another aspect of the present invention, there is provided a method for touching up of a drum type washing machine, the method comprising: tumbling laundry, and ejecting steam with carrying out the step of tumbling at the same time.

Preferably, the step of tumbling is automatically executed when the door is not opened after a certain time elapses after the dehydrating process or after the dehydrating process, or manually executed by optionally pushing the touch up button after the dehydrating process.

Preferably, the step of tumbling comprises rotating the drum for a certain time, and stopping rotating the drum. Here, the steps are repeated multiple times. Preferably, the step of ejecting steam is executed from an initial time of the tumbling step and then stopped before the tumbling step is finished, or is executed until the tumbling step is finished. Preferably, the step of ejecting steam comprises supplying water to the steam generating device when the tumbling step begins to be executed, heating the supplied water, and ejecting steam generated by heating the water to the laundry for a certain time.

In the meantime, it may further comprise sensing an amount of laundry before the step of ejecting steam is executed.

Preferably, a time for ejecting steam is increased when an amount of laundry sensed in the step of sensing the amount of laundry is more than a reference amount while the time for ejecting the steam is decreased when the amount of laundry is less than the reference amount. Alternately, a time for tumbling the laundry is increased when an amount of laundry sensed in the step of sensing the amount of laundry is more than a reference amount, while the time for tumbling the laundry is decreased when the amount of laundry is less than the reference amount.

In accordance with still another aspect of the present invention, there is provided a drum type washing machine comprising: a cabinet forming an external appearance, a door installed at a front side of the cabinet, a tub installed in the cabinet so as to store water therein, a drum rotatably installed in the tub and receiving laundry therein, and a steam generating device for supplying steam to the laundry loaded in the drum, so as to remove wrinkles on laundry by controlling the drum and the steam generating device.

Here, preferably, the drum type washing machine further comprises a control panel installed on a front surface of the cabinet. The control panel is provided with a touch up button to be pushed by a user. By pushing the touch up button, a touch up function that a tumbling process in which the drum is rotated for a certain time and stopped is repeated and the steam generating device ejects steam, at the same time, so as to remove wrinkles on the laundry is executed, preferably.

Alternately, preferably, a touch up function that a tumbling process in which the drum is rotated for a certain time and stopped is repeated and the steam generating device ejects steam, at the same time, so as to remove wrinkles on the laundry is executed when a certain time elapses after a dehydrating process is finished.

Alternately, preferably, a touch up function that a tumbling process in which the drum is rotated for a certain time and stopped is repeated and the steam generating device ejects steam, at the same time, so as to remove wrinkles on the laundry is executed when the door is not opened after a certain time elapses after the dehydrating process is finished.

Here, preferably, a time for tumbling of the drum and a time for ejecting steam by the steam generating device are increased when an amount of laundry is large.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate preferred embodiments of the invention and together with the description serve to explain the principles of the invention.

In the drawings.

DETAILED DESCRIPTION OF THE INVENTION

Description will now be given in detail of the preferred embodiments of the present invention, examples of which are illustrated in the accompanying drawings.

Figure 1:
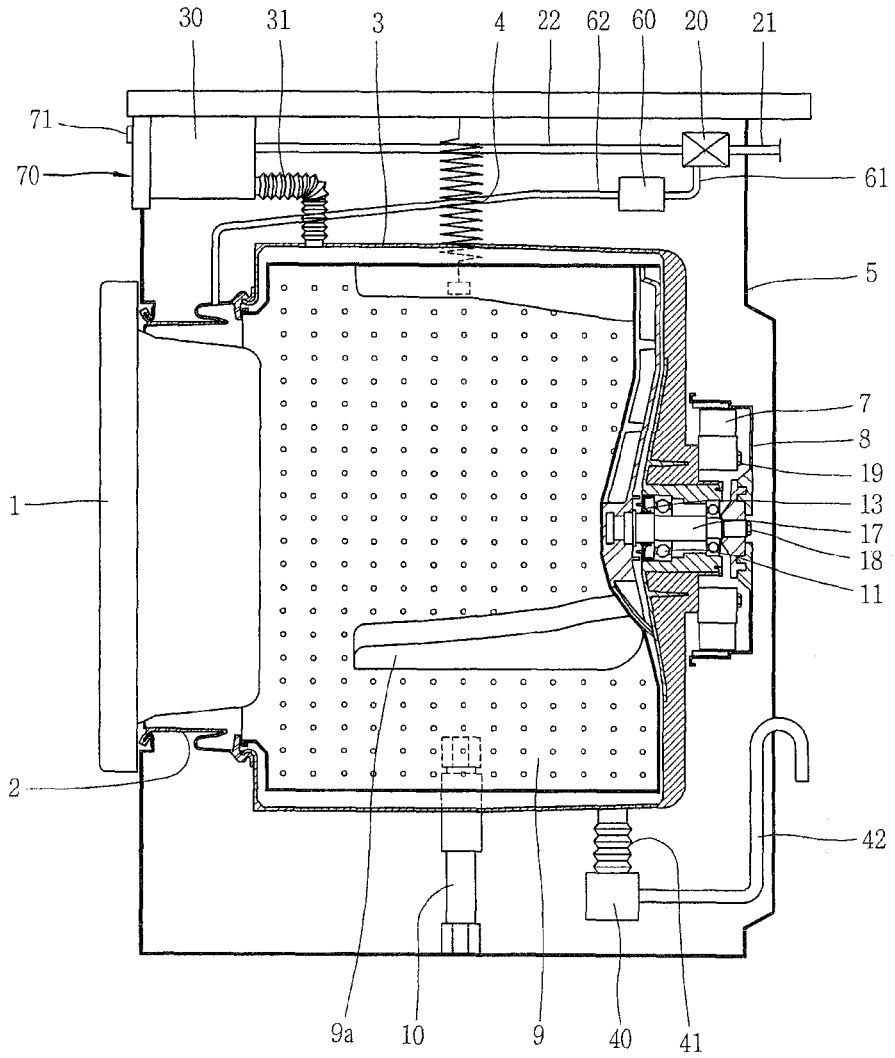
FIG. 1 is a schematic view showing a drum type washing machine having a touch up function in accordance with one embodiment of the present invention.
Figure 2:
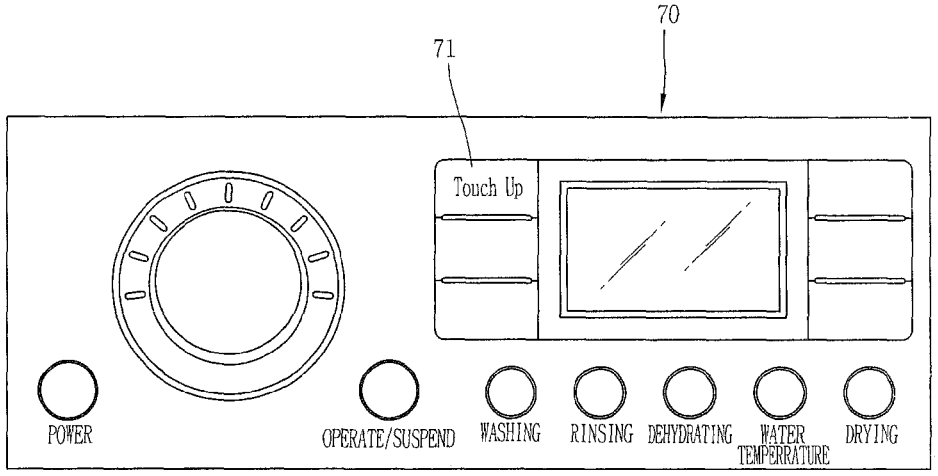
FIG. 2 is an extracted view showing a control panel having a touch up button in FIG. 1.

Hereafter, a drum type washing machine having a touch up function and a method for touching up thereof in accordance with one embodiment of the present invention will be described in detail. FIG. 1 is a schematic view showing a drum type washing machine having a touch up function in accordance with the one embodiment of the present invention, and FIG. 2 is an extracted view showing a control panel having a touch up button in FIG. 1.

Referring to FIG. 1, the drum type washing machine having the touch up function in accordance with the one embodiment of the present invention includes a cabinet 5 forming an external appearance, a tub 3 installed in the cabinet 5 so as to store water therein, a drum 9 rotatably installed in the tub 3 and receiving laundry therein, driving motors 7, 8 for rotating the drum 9, a rotation shaft 17 for transferring a rotational force from the driving motors 7, 8 to the drum 9, a bearing 11 for supporting the rotation shaft 17, a sealing member 13 for preventing water between the tub 3 and the drum 9 from penetrating into the bearing 11, a detergent supply device 30 for supplying water mixed with detergent to the tub 3, a water supply device 20 configured with a plurality of valves so as to supply or stop supplying water to the detergent supply device 30 and a steam generating device 60, a drain pump 40 for draining the water stored in the tub 3 by outwardly pumping it, the steam generating device 60, S/G for supplying steam to laundry loaded in the drum 9 so as to enhance sterilizing and washing performance, and a control panel 70 for controlling an overall operation of the washing machine by receiving a manipulation command from a user.

A door 1 is disposed at a front side of the cabinet 5, and a gasket 2 is installed between the door 1 and the tub 3.

A locking spring 4 for supporting the tub 3 is installed between an upper inner surface of the cabinet 5 and an outer upper surface of the tub 3. A friction damper 10 for reducing vibration of the tub 3 is installed between a lower inner surface of the cabinet 5 and an outer lower surface of the tub 3.

A plurality of lifters 9*a* for moving the laundry up and down are disposed in the drum 9.

The driving motors 7, 8 consist of a stator 7 implemented as a direct drive type motor and provided with a coil wound at a slot, and a rotor 8 rotating on an outer circumferential surface of the stator 7 and provided with a permanent magnet 12 therein.

The stator 7 is coupled to a rear wall of the tub 3 by a plurality of coupling members 19.

The rotor 8 is coupled to a rear end portion of the rotation shaft 17 by a coupling member 18.

Once the coil of the stator 7 receives a power and thus to become electromagnetic, the rotor 8 is rotated by an interaction between the coil of the stator 7 and the permanent magnet 12 attached into the rotor 8. A rotational force of the rotor 8 is transferred to the drum 9 through the rotation shaft 17.

The bearing 11 is installed in a bearing housing 15 and includes a front bearing positioned at a front side of the rotation shaft 17 and a rear bearing positioned at a rear side of the rotation shaft 17.

The sealing member 13 insertedly installed on the outer circumference of the rotation shaft 17, thereby preventing water between the tub 3 and the drum 9 from penetrating into the bearing 11.

The detergent supply device 30 serves to mix the supplied water with detergent and then supply it to the tub 3 through a supply pipe 31. One exemplary detergent supply device 30 can be configured as followings. That is, the detergent supply device 30 may include a case and a detergent container installed in the case so as to store various kinds of detergent.

A siphon pipe is formed on a bottom of the detergent container. And, a supply inlet connected to a connection pipe 22 is formed at the upper side of the case, and a detergent outlet connected to a supply pipe 31 is formed on the bottom of the case.

With such configuration, the water supplied through the connection pipe 22 is mixed with the detergent stored in the detergent container, and then flows out of the detergent container through the siphon pipe when the water mixed with the detergent reaches a specific level. The water mixed with the detergent is supplied to the tub 3 through the supply pipe 31.

A supply pipe 21 connected to an external water supply source, the connection pipe 22 connected to the detergent supply device 30 and a supply pipe 61 connected to the steam generating device 60 are installed at the water supply device 20.

A drain pipe 41 connected to the lower side of the tub 3 and a connection pipe 42 connected to an external drain are respectively installed at the drain pump 40.

The supply pipe 61 connected to the water supply device 20 and a connection pipe 62 connected to the gasket 2 are respectively installed at the steam generating device 60.

One exemplary steam generating device 60 may be configured as followings. That is, the steam generating device 60 may be configured with a case, a heater mounted in the case and a water level sensor mounted at the case so as to sense a water level.

The case is provided with a supply inlet connected to the supply pipe 61 and a steam outlet connected to the connection pipe 62.

With such configuration, water supplied through the supply inlet flows out through the steam outlet in a steam state after being heated by the heater. The steam flowing out of the steam outlet is spread over the laundry loaded in the drum 9.

Referring to FIG. 2, in order to prevent the laundry left after being dehydrated from being wrinkled, the control panel 70 is provided with a touch up button 71 by which the user can allow to tumble the laundry and eject steam to the laundry at the same time.

Hereafter, a method for touching up of the drum type washing machine will be described.

Figure 3:
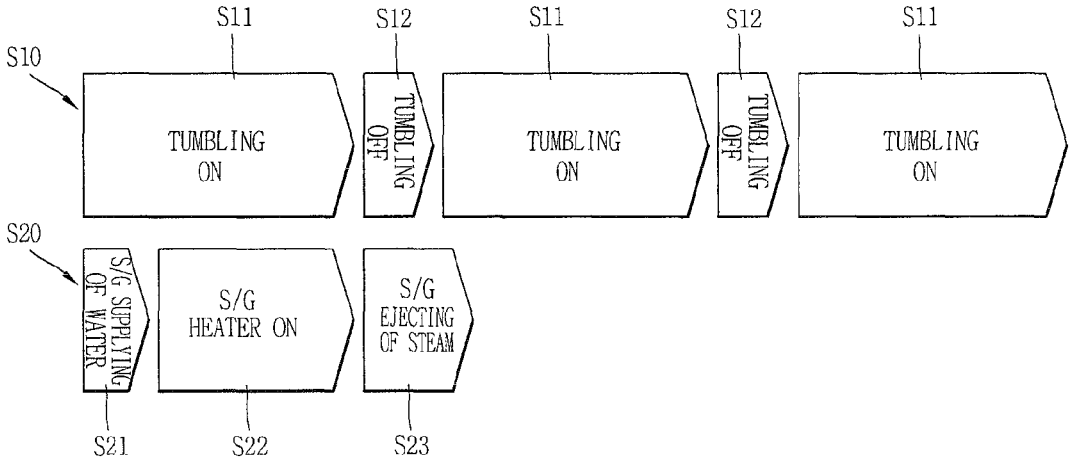
FIG. 3 is a block diagram showing a method for touching up of the drum type washing machine of FIG. 1.

FIG. 3 is a block diagram showing a method for touching up of the drum type washing machine of FIG. 1. Referring to FIG. 3, the method for touching up of the drum type washing machine includes tumbling the laundry after a dehydrating process (S10), and ejecting steam carrying out the tumbling step (S10) at the same time (S20).

The tumbling step (S10) is automatically executed when the door 1 (see FIG. 1) is not opened after a certain time elapses after the dehydrating process is finished or after the dehydrating process is finished, or manually executed by optionally pushing the touch up button 71 (see FIG. 2) after the dehydrating process is finished.

The tumbling step (S10) includes tumbling the laundry by rotating the drum 9 (see FIG. 1) for a certain time (approximately 16 seconds) (S11), and stopping tumbling the laundry by intermittently putting pause to the drum 9 (see FIG. 2) (approximately 4 seconds) between the rotating processes (S12). The step of tumbling the laundry (S11) and the step of stopping tumbling the laundry (S12) are repeated. That is, as shown in FIG. 3, the step of tumbling the laundry (S11) is repeated three times, and the step of stopping tumbling the laundry (S12) is repeated twice between moments executing the step of tumbling the laundry (S11).

While the laundry is tumbled by the rotation of the drum 9 (see FIG. 1) and the steam is ejected to the laundry at the same time, wrinkles on the laundry left in the drum type washing machine can be removed. Accordingly, it is not required for the user to additionally execute rinsing and dehydrating processes or ironing so as to remove the wrinkles on the laundry, thus it is convenient. And, since it is not required to additionally execute the rinsing and dehydrating processes, it is capable of preventing unwanted consumption of water and electricity.

The step of ejecting steam (S20) is executed from an initial time of the tumbling step (S10) and then stopped before the tumbling step (S10) is finished. Alternately, the step of ejecting steam (S20) may be executed until the tumbling step (S10) is finished with carrying out side by side.

The step of ejecting steam (S20) includes supplying water to the steam generating device 60 (see FIG. 1) when the tumbling step S11 begins to be executed (S21), heating the supplied water (S22), and ejecting steam generated by heating the water to the laundry for a certain time (S23).

Figure 4:
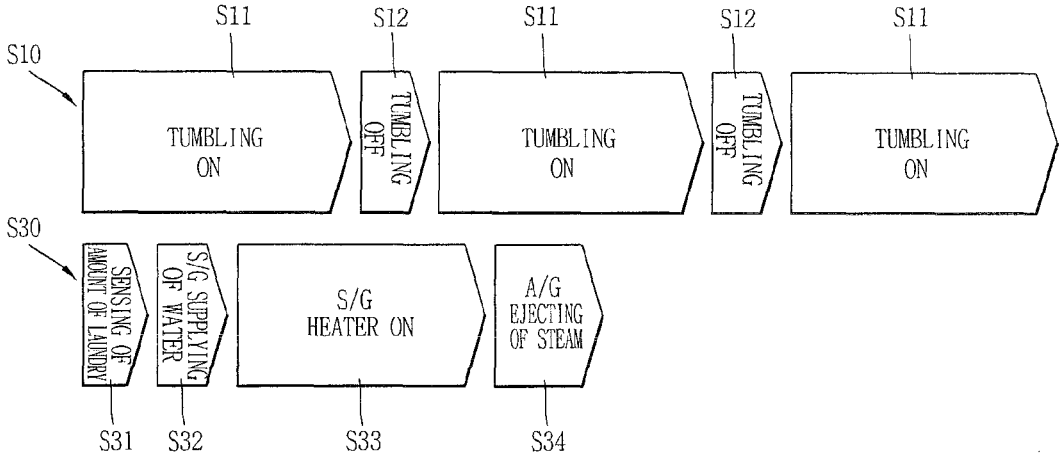
FIG. 4 is a block diagram showing a variation of a method for touching up.

FIG. 4 is a block diagram showing a variation of the method for touching up. Referring to FIG. 4, the method further includes sensing an amount of laundry before the step of ejecting steam (S23) is executed (S30).

Other steps are same as the aforementioned, thus will be omitted.

When the amount of laundry sensed in the step of sensing the amount of laundry (S30) is more than a reference amount (approximately more than 3 kg), a time for ejecting the steam is increased. On the contrary, the amount of laundry is less than the reference amount (approximately less than 3 kg), the time for ejecting the steam is decreased. Alternately, the amount of laundry sensed in the step of sensing the amount of laundry (S30) is more than the reference amount (approximately more than 3 kg), a time for tumbling is increased. On the contrary, the amount of laundry is less than the reference amount (approximately less than 3 kg), the time for tumbling is decreased. Alternately, the amount of laundry sensed in the step of sensing the amount of laundry (S30) is more than the reference amount (approximately more than 3 kg), a time for ejecting steam is increased. On the contrary, the amount of laundry is less than the reference amount (approximately less than 3 kg), the time for ejecting steam is decreased. Alternately, the amount of laundry sensed in the step of sensing the amount of laundry (S30) is more than the reference amount (approximately more than 3 kg), a time for tumbling and a time for ejecting steam are simultaneously increased. On the contrary, the amount of laundry is less than the reference amount (approximately less than 3 kg), the time for tumbling and the time for ejecting steam are simultaneously decreased.

Meanwhile, the amount of laundry is sensed according to variation of a load applied to a motor while rotating the drum. That is, a principle that the load applied to the motor is increased when the amount of laundry is more than the reference amount, while the load applied to the motor is decreased when the amount of laundry is less than the reference amount is adapted thereto. Else, the amount of laundry may be variously measured by disclosed methods for sensing the amount of laundry.

As such, by adjusting the time for tumbling and the time for ejecting steam according to the amount of laundry, it is capable of effectively removing wrinkles on the laundry left in the drum type washing machine.

The drum type washing machine having a touch up function in accordance with the present invention is provided with a touch up button for implementing a method for touching up for removing wrinkles on the laundry left in the drum type washing machine. Accordingly, it is not required for the user to additionally execute rinsing and dehydrating processes, or ironing so as to remove wrinkles on the laundry. And, since it is not required to additionally execute the rinsing and dehydrating processes, it is capable of preventing unwanted consumption of water and electricity.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present inventive features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed:

1. A method for touching up of a drum type washing machine, the method comprising:

performing, by a rotation of a drum, a dehydrating process;

determining whether a door is not opened for a certain amount of time after the dehydrating process is finished;

tumbling, by a rotation of the drum, laundry in response to a determination that the door is not opened for the certain amount of time after the dehydrating process is finished; and ejecting, by a steam generating device, steam while carrying out the tumbling at a same time.

2. The method of claim 1, wherein the tumbling comprises:

rotating the drum for a certain amount of time; and stopping the rotating of the drum.

3. The method of claim 2, wherein the tumbling is repeated multiple times.

4. The method of claim 1, wherein ejecting the steam is executed from an initial time of the tumbling and the ejecting of the steam is then stopped before the tumbling is finished.

5. The method of claim 1, wherein ejecting the steam is executed until the tumbling is finished from an initial time of the tumbling.

6. The method of claim 1, wherein ejecting the steam comprises:

supplying water to the steam generating device;

heating the supplied water; and ejecting steam generated by heating the water to the laundry for a certain amount of time.

7. The method of claim 1, further comprising sensing, by a sensor sensing an amount of laundry, an amount of laundry before ejecting the steam is executed.

8. The method of claim 7, wherein an amount of time for ejecting the steam is increased when an amount of laundry sensed in the sensing the amount of laundry is more than a reference amount, while the amount of time for ejecting the steam is decreased when the amount of laundry is less than the reference amount.

9. The method of claim 7, wherein an amount of time for tumbling the laundry is increased when an amount of laundry sensed in the sensing the amount of laundry is more than a reference amount, while the amount of time for tumbling the laundry is decreased when the amount of laundry is less than the reference amount.

10. The method of claim 7, wherein an amount of time for ejecting steam and an amount of time for tumbling are increased when an amount of laundry sensed in the sensing the amount of laundry is more than a reference amount, while the amount of time for ejecting steam and the amount of time for tumbling are decreased when the amount of laundry is less than the reference amount.

11. A method for touching up of a drum type washing machine, comprising:

completing, by a rotation of a drum, a dehydrating process;

determining that a door is not opened for a prescribed amount of time after completing the dehydrating process;

tumbling, by a rotation of the drum, laundry in response to a determination that the door is not opened for the prescribed amount of time after completing the dehydrating process; and ejecting, by a steam generating device, steam while simultaneously tumbling the laundry.

12. The method of claim 11, wherein tumbling the laundry comprises:

rotating the drum for a certain amount of time; and stopping rotating the drum.

13. The method of claim 12, wherein tumbling the laundry is repeated multiple times.

14. The method of claim 11, wherein ejecting the steam is executed from an initial time of the tumbling and is then stopped before the tumbling is finished.

15. The method of claim 11, wherein ejecting the steam is executed until the tumbling is finished from an initial time of the tumbling.

16. The method of claim 11, wherein an amount of time for ejecting the steam is increased when a sensed, by a sensor sensing an amount of laundry, amount of laundry before ejecting the steam is more than a reference amount, while the amount of time for ejecting the steam is decreased when the sensed amount of laundry is less than the reference amount.

17. The method of claim 11, wherein an amount of time for tumbling the laundry is increased when a sensed, by a sensor sensing an amount of laundry, amount of laundry before ejecting the steam is more than a reference amount, while the amount of time for tumbling the laundry is decreased when the sensed amount of laundry is less than the reference amount.

18. The method of claim 11, wherein an amount of time for ejecting steam and an amount of time for tumbling are increased when a sensed, by a sensor sensing an amount of laundry, amount of laundry before ejecting the steam is more than a reference amount, while the amount of time for ejecting steam and the amount of time for tumbling are decreased when the sensed amount of laundry is less than the reference amount.

* * * * *